United States Patent [19]

Watanabe et al.

[11] Patent Number: 4,806,968

[45] Date of Patent: Feb. 21, 1989

[54] DRIVE UNIT FOR A COPYING MACHINE

[75] Inventors: Junji Watanabe, Yokohama; Takeshi Eguchi, Oomiya, both of Japan

[73] Assignee: Kabushiki Kaisha Toshiba, Kawasaki, Japan

[21] Appl. No.: 159,950

[22] Filed: Feb. 24, 1988

[30] Foreign Application Priority Data

Feb. 27, 1987 [JP] Japan ..... 62-44527

[51] Int. Cl.[4] ..... G03G 15/00

[52] U.S. Cl. ..... 355/3 R; 355/8; 355/3 DD; 355/15

[58] Field of Search ..... 355/8, 3 DD, 3 R, 15, 355/50, 51, 55

[56] References Cited

U.S. PATENT DOCUMENTS

| | | | |
|---|---|---|---|
| 4,135,806 | 1/1979 | Abe et al. | 355/3 R |
| 4,148,578 | 4/1979 | Bujese | 355/8 |
| 4,186,919 | 2/1980 | Miciukiewicz | 355/8 X |
| 4,320,954 | 3/1982 | Ikeda et al. | 355/8 X |
| 4,589,760 | 5/1986 | Iimori | 355/8 |
| 4,607,943 | 8/1986 | Yoshioka et al. | 355/55 X |
| 4,666,285 | 5/1987 | Iida et al. | 355/3 R |
| 4,673,283 | 6/1987 | Hisajima et al. | 355/8 X |

*Primary Examiner*—R. L. Moses

*Attorney, Agent, or Firm*—Cushman, Darby & Cushman

[57] ABSTRACT

A drive unit for a copying machine comprises a motor for driving a photoconductive drum, the developing rollers, the fixing rollers, and a cooling fan. When a copying operation takes place, the motor is rotated in the forward direction, whereby the drum and the other components are driven simultaneously. At this time, a cleaning blade is brought into contact with the drum, thereby removing residual toner therefrom. After completion of the copying operation, the cleaning blade is disengaged from the drum, and the motor is reversed. At this time, by means of a one-way clutch, only the drum is allowed to rotate in the reverse direction. After the drum is rotated reversely through a predetermined angle, only the cooling fan is allowed to operate, this being due to the action of a dog clutch.

11 Claims, 7 Drawing Sheets

DRIVE UNIT FOR A COPYING MACHINE

BACKGROUND OF THE INVENTION

1. Field of the Invention

The present invention relates to a drive unit applicable to a copying machine.

2. Description of the Related Art

In the case of electronic copying machines, for example, particles of developing agent remaining on the surface of a photoconductive drum are scraped off by means of a cleaning blade after the developing and transfer processes have been completed. The blade is made to engage with the surface of the drum at the start of a copying operation, and is disengaged therefrom upon completion of the copying process.

When the copying operation is finished, the blade is disengaged from the photoconductive drum. The drum does not stop at once, continuing t rotate on its own inertia. Therefore, some developer particles remaining on the surface of the drum may carried past the point where the blade will contact at the start of the next copying operation. These residual particles cannot be removed by the blade during the next copying operation, and will inevitably form black stripes on a copy image, thus lowering the quality of the copy image.

To avoid this problem, the photoconductive drum is reversely rotated through a predetermined angle after the cleaning blade has been disengaged from the drum at the end of the copying operation. At the start of the next copying operation, the blade is brought into contact with the cleaned portion of the surface of the drum. Therefore, in the next copying operation, the blade sweeps that portion of the surface of the drum on which the developer particles remain, thus removing the residual particles from the drum.

In the conventional electronic copying machines, the developing rollers, fixing rollers, or the like, are driven simultaneously by the motor used to drive the photoconductive drum. The inertia of each of these rollers acts on the drum. As a result, it is difficult to stop the reversely rotating drum in a predetermined position.

The inside of the electronic copying machines must be cooled not only during the copying operation, but also during a standby period. A motor and a fan coupled to the motor are used exclusively during the standby period to cool the inside of the machines. Both the motor and the fan are relatively expensive components. Hence, in order to reduce the cost of the machines, it is desired that the inside of the machines be cooled during the standby period, without using such a motor and a fan.

SUMMARY OF THE INVENTION

The object of the present invention is to provide a drive unit for a copying machine wherein the image carrier can be accurately stopped at a predetermined position by being rotated reversely, and wherein the inside of the copying machine can be cooled by use of fewer components, during standby periods between copying operations.

According to an aspect of the present invention, there is provided a drive unit for a copying apparatus, which comprises an image carrier rotatable in both forward and reverse directions and carrying a latent image thereon; visualizing means rotatable in both forward and reverse directions and adapted to visualize the latent image; cooling means for cooling the inside of the copying machine; drive means rotatable in both forward and reverse directions and adapted to drive the image carrier, the visualizing means, and the cooling means; first driving force transmission means for transmitting the driving force of the drive means to the image carrier, to rotate the image carier in the forward and reverse directions as the drive means rotates in the forward and reverse directions, respectively; second driving force transmission means adapted to transmit the driving force of the drive means to the visualizing means, to rotate the visualizing means in the forward direction when the drive means rotates in the forward direction, and not to transmit the driving force of the drive means to the visualizing means when the drive means rotates in the reverse direction; intermittent driving force transmission means for intermittently allowing the the first driving force transmission means to transmit the driving force to the image carrier and second driving force transmission means to transmit the driving force to the visualizing means; and third driving force transmission means for transmitting the driving force of the drive means directly to the cooling means.

During the copying operation, according to the present invention, at least the image carrier, developing means, fixing means, and cooling means are driven simultaneously. After the end of the copying operation, the drive means is reversed. Thereupon, only the image carrier is rotated reversely. By doing this, the force of inertia acting on the drive means can be made smaller. After the revers rotation of the image carrier is finished, the transmission of the driving force by the first and second driving force transmission means is discontinued. As a result, only the cooling means is driven by the drive means. Thus, the copying operation and cooling operation, during the standby period before the start of the copying operation, can be performed with use of one and the same drive means.

DETAILED DESCRIPTION OF THE PREFERRED EMBODIMENTS

An embodiment of the present invention will now be described in detail with reference to the accompanying drawings.

Figure 1:
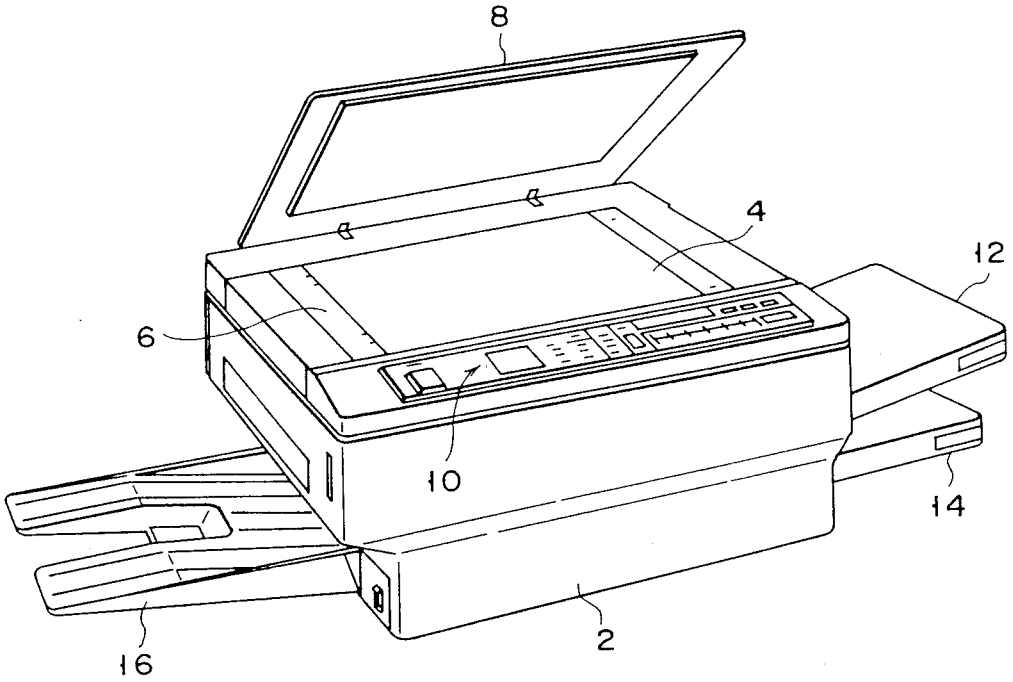
FIG. 1 Is an external perspective view of a copying machine using a drive unit according to the present invention.

FIG. 1 schematically shows a copying machine which uses a shifting apparatus according to the present invention. In FIG. 1, numeral 2 designates a housing. An original table (transparent glass) 4 for retaining an original is fixed on the top surface of housing 2. Fixed scale 6 is provided on one side of table 4. It serves as a reference mark for original setting. Located beside table 4, swingable original cover 8 is supported on housing 2. Control panel 10 is mounted on the front side of the top surface of housing 2. Upper and lower sheet cassettes 12 and 14 are attached to one side of housing 2, and receiving tray 16 is attached to the other side.

Figure 2:
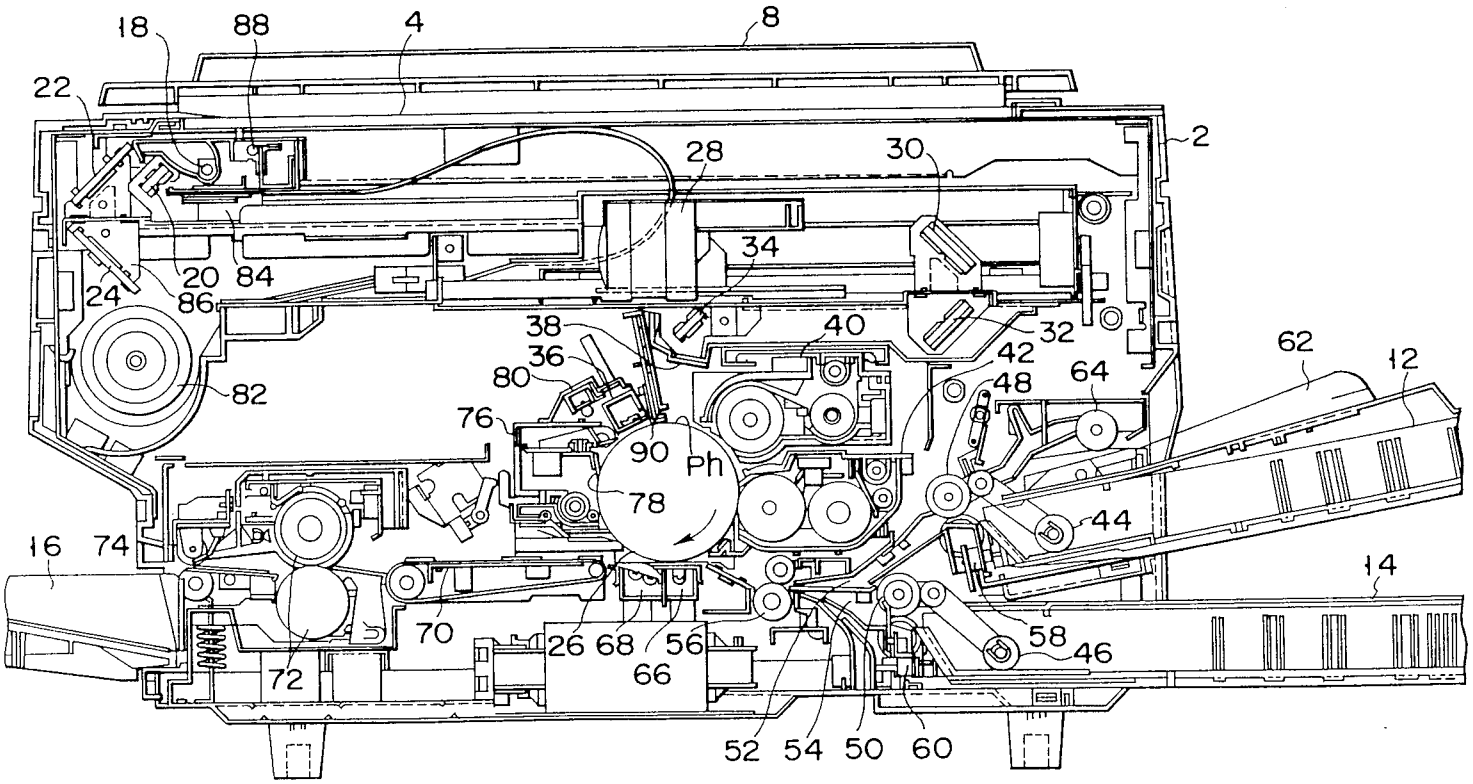
FIG. 2 is a side sectional view of the copying machine shown in FIG. 1.

As shown in FIG. 2, an optical system, including exposure lamp 18 and mirrors 20, 22 and 24, is disposed under original table 4. The optical system is adapted to reciprocate along the underside of table 4. As it moves forward, the original on table 4 is exposed for scanning. While the optical system is reciprocating, mirrors 22 and 24 are moved at a speed half that of mirror 20 and lamp 18 so that the length of an optical path, extending from the original to photoconductive drum 26, is kept constant. A light from lamp 18 is applied to the original. The reflected light from the original is reflected successively by mirrors 20, 22 and 24, and then transmitted through lens block 28 for scale change. The light is further reflected successively by mirrors 30, 32 and 34, and then guided to drum 26. Thereupon, an image of the original is formed on the surface of drum 26.

Photoconductive drum 26 is rotated in the direction of the arrow of FIG. 2. The surface of drum 26 is first charged by main charger 36. Then, the charged drum surface passes through exposure region ph. At this time, an optical image corresponding to the original image is guided to the drum surface through slit 38. As a result, an electrostatic latent image is formed on the surface of drum 26. This image is visualized by means of first or second developing unit 40 or 42. Thus, a toner image is formed on the drum surface. For example, first and second units 40 and 42 are stored with red and black toners, respectively. These developing units are operated alternatively as required. They are removably mounted in housing 2. The colors of the toners in units 40 and 42 are indicated on control panel 10. The color indication on panel 10 depends, for example, on the state of connection between a plurality of pins of a pair of connectors (not shown) arranged in housing 2.

Paper sheets are taken out one by one from upper or lower cassette 12 or 14 by means of paper-supply roller 44 or 46 and feed rollers 48 or 50. Each sheet is guided to aligning rollers 56 via sheet guide path 52 or 54. Then, the sheet is delivered to a transfer section by means of rollers 56. One of cassettes 12 and 14 is selected by operating cassette selection key 108 (mentioned later) of control panel 10. The sizes of cassettes 12 and 14 are detected by means of cassette-size detection switches 58 and 60, respectively. Switches 58 and 60 are each composed of a plurality of microswitches, which are turned on and off as cassettes 12 and 14 of different sizes are inserted into the apparatus. Sheet-bypass guide 62 is attached to the top portion of upper cassette 12. A paper sheet inserted manually through guide 62 is delivered to feed rollers 48 by means of delivery roller 64. Thereafter, the sheet is transported in the same manner as each sheet fed from upper cassette 12.

Thus delivered to the transfer section, the sheet is caused to adhere to the surface of photoconductive drum 26. In this state, the toner image on drum 26 is transferred to the surface of the sheet by the agency of transfer charger 66. Thereafter, the sheet, with the transferred image thereon, is separated electrostatically from drum 26 by means of separation charger 68. The separated sheet is delivered to a pair of fixing rollers 72 by means of conveyor belt 70. As the sheet passes between rollers 72, the toner image is fixed on the sheet. Thereafter, the sheet is discharged onto tray 16 by means of exit rollers 74.

Toner particles remaining on the surface of photoconductive drum 26, without having been transferred therefrom to the surface of the sheet, are removed by means of cleaning blade 78 of cleaner 76. Thereafter, a residual image on the surface of drum 26 is erased by means of discharge lamp 80. Thus, the drum surface is restored to its initial state. Numeral 82 designates a cooling fan used to prevent a temperature rise inside housing 2. Exposure lamp 18 and mirror 20 are mounted on first carriage 84, while mirrors 22 and 24 are mounted on second carriage 86.

First carriage 84 is provided with spot light source 88, which is movable at right angles to the traveling direction of carriage 84.

Erasure array 90 is provided between main charger 36 and exposure region ph of photoconductive drum 26. Array 90 includes a plurality of light emitting elements which are arranged along the longitudinal direction of drum 26. In partially erasing an original image, the emitting elements of array 90 are turned on corresponding to erasure areas designated by spot light source 88, for example. Thus, the surface of drum 26 is de-electrified. If the de-electrified surface portion of drum 26 is exposed at exposure region ph, thereafter, no electrostatic latent image can be formed on that portion. In consequence, the original image is erased.

Figure 3:
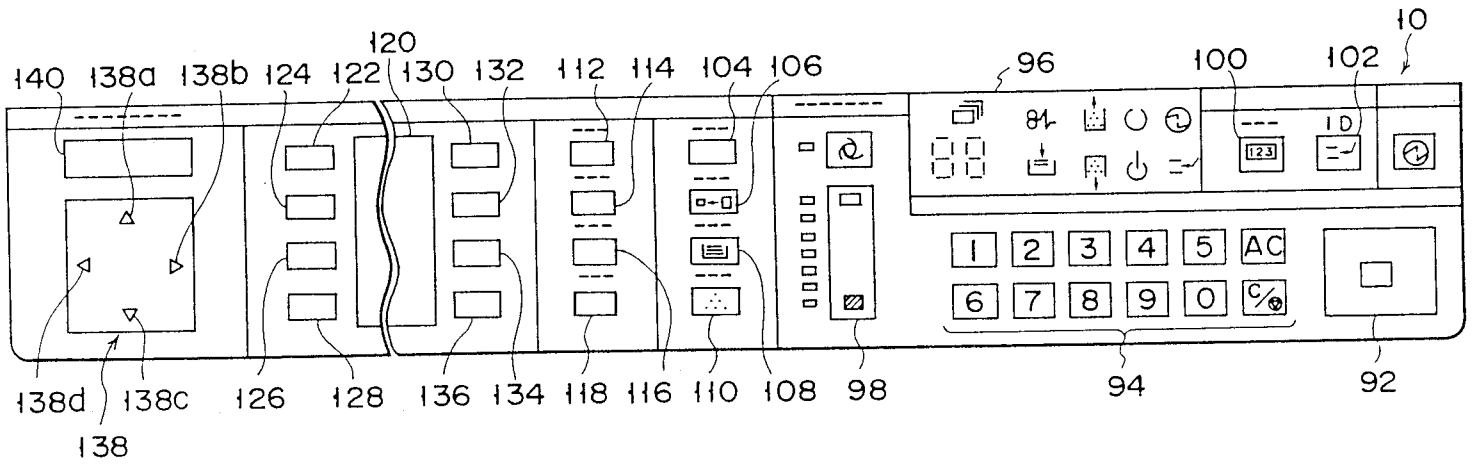
FIG. 3 is a plan view showing a control panel of the copying machine of FIG. 1.

Referring now to FIG. 3 showing control panel 10, there are shown copy key 92, numeric pad 94, display section 96, density setting section 98, count command key 100, and interruption key 102. Copy key 92 is used to give a copy start command, and numeric pad 94 is operated in setting the number of copies to be made and the like. Display section 96 indicates the operating conditions of various parts, jamming, etc. Setting section 98 is operated in setting the copy density. Command key 100 is used to indicate the total number of copies, the number of copies for each color, etc. Interruption key 102 is operated when one person starts one copying operation during another operation performed by another person. There are also shown full-scale key 104, scale setting key 106, cassette selection key 108, color change key 110, mode memory key 112, and information key 114. Full-scale key 104 is used to adjust the copy size to a full-scale size (100%). Setting key 106 is used to set the copy scale. Selection key 108 is operated in selecting upper or lower cassette 12 or 14. Color change key 110 is used to change the toner color for copying. When editing key 118 (not shown) is operated, for example, the erasure range of the original may be designated by means of spot light source 88. In such a case, memory key 112 is used to cause a memory to store the designated erasure range and the like, or to read out information, such as the erasure range previously stored in the memory. Information key 114 is used to obtain information corresponding to each mode. If key 114 is operated in case of jamming, for example, information for the removal of jamming is indicated on a display mentioned later. Numeral 116 denotes a function check key. By operating check key 116, the set functions can be indicated on display 120 (mentioned later). Numeral 118 denotes the editing key which is operated in a multi-copying mode, double-sided copying mode, or partial-erasure mode such that copying is effected after part of the original image is erased. Numeral 120 designates the display which is formed of, e.g., a liquid-crystal dot matrix panel. For example, the set conditions of the copying machine are indicated by characters on display 120. Thus, when each of keys 100 to 116 is depressed, its corresponding characters are displayed. If jamming occurs in the middle of copying operation, for example, the location of the jamming and the remedy, in characters and diagrams, appear on display 120. Control keys 122 to 136 are arranged on either side of display 120. These keys are used to select the various functions indicated on display 120. Numeral 138 denotes a shifting key for shifting the position of spot light source 88. Key 138 bears arrows 138*a*, 138*b*, 138*c* and 138*d* which indicate four directions, individually. If key 138 is depressed on any of its arrows 138*a* to 138*d* or thereabout, it is tilted corresponding to the direction indicated by the selected arrow. When key 138 is operated in this manner, light source 88 is moved in the specified direction corresponding to the tilt of the key. Numeral 140 designates a position designating key used to input the coordinate position indicated by light source 88.

Figure 4:
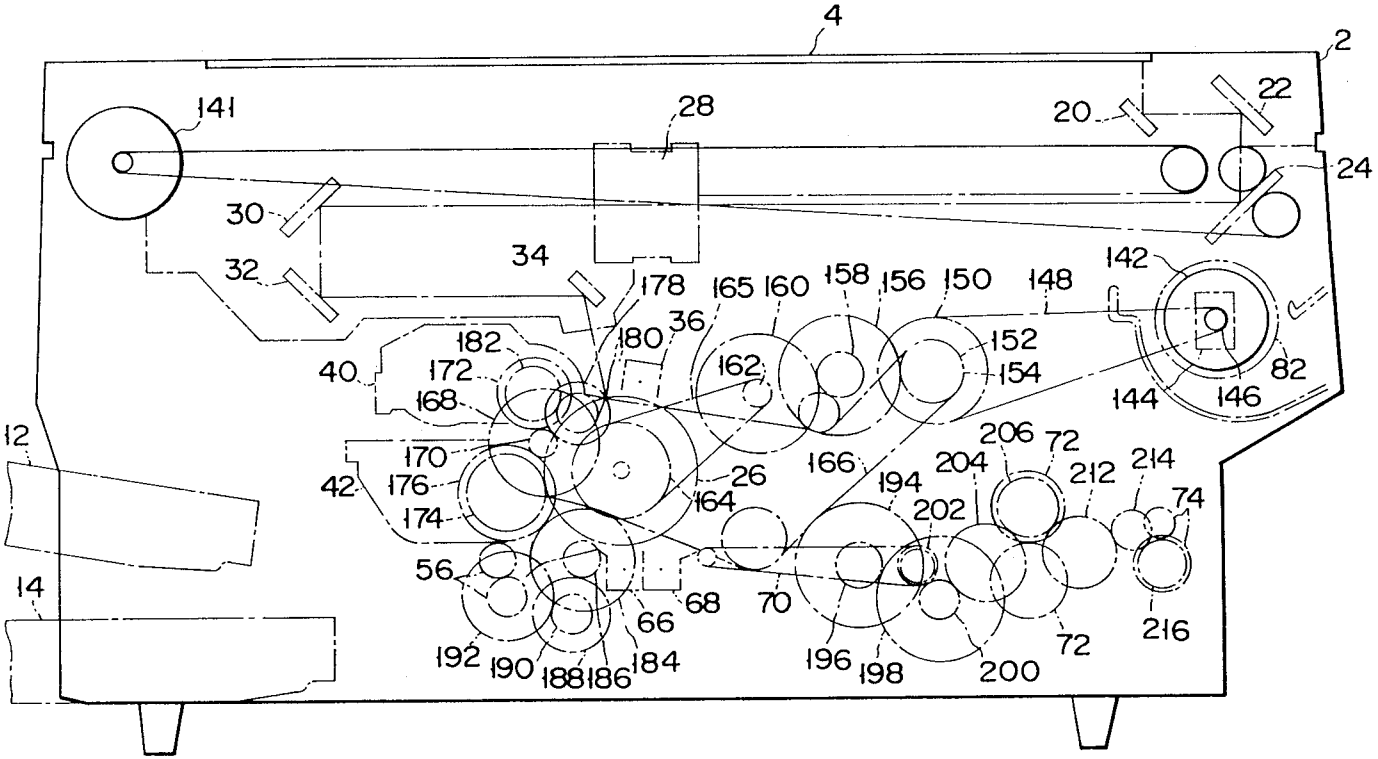
FIG. 4 is a side view schematically showing the drive unit according to the invention provided inside the copying machine of FIG. 1.
Figure 5:
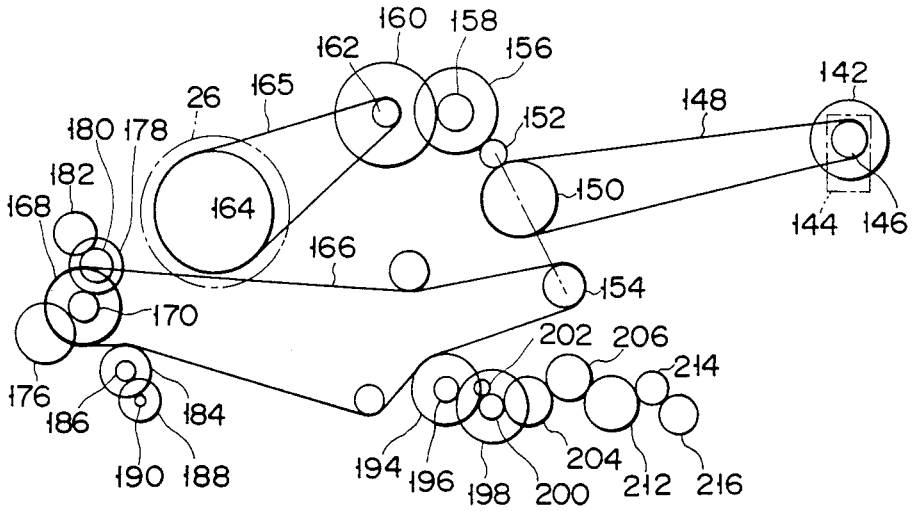
FIG. 5 is a schematic view of the drive unit shown in FIG. 4.

FIGS. 4 and 5 schematically show a drive system of the copying machine. Numeral 141 designates a motor, which is used to drive first and second carriages 84 and 86. Numeral 142 designates another motor, which is connected with cooling fan 82 by means of boss portion 82*a* (see FIG. 6). The driving force of motor 142 is transmitted to gear 146 by means of dog clutch 144, which will be mentioned later. The driving force transmitted to gear 146 is transmitted gear 150 by means of timing belt 148. Gear 150 is fitted coaxially with gear 152 and one-way clutch 154. Clutch 154 is adapted to be rotated in the same manner as gear 152 when motor 142 is driven in the counterclockwise direction of FIGS. 4 and 5. When motor 142 is driven clockwise, on the other hand, clutch 154 is not rotated. Gear 156, used to drive the photoconductive drum, is in mesh with gear 152 which is attached to gear 150. It is fitted with coaxial gear 158. Gear 160 is in mesh with gear 158. It is fitted with coaxial gear 162. Timing belt 165 is passed around gear 162 and gear 164 which is attached to photoconductive drum 26.

A gear (not shown) is provided integrally with one-way clutch 154. Double-toothed timing belt 166 is passed around this gear. Gear 168, used to drive the developing units, is driven by belt 166. It is fitted with coaxial gear 170, which is used to drive developing rollers 172 and 174 of developing units 40 and 42. When unit 42 is selected, gear 170 is caused to engage gear 176 which is attached to roller 174. When unit 40 is selected, on the other hand, gear 170 is coupled to idle gear 178, which is fitted with coaxial gear 180. Gear 180 is coupled to gear 182 which is attached to developing roller 172.

Motor 142 also serves to drive aligning rollers 56, conveyor belt 70, fixing rollers 72, and exit rollers 74. Timing belt 166 is passed around gear 184. When gear 184 is driven, rollers 56 are rotated by means of gears 186, 188, 190 and 192 in succession.

Timing belt 166 is passed around gear 194. When gear 194 is driven, conveyor belt 70 is driven by means of gears 196, 198, 200 and 202 in succession. When gear 200 is driven, fixing rollers 72 are rotated by means of gears 204 and 206 in succession. When gear 206 is driven, exit rollers 74 are rotated by means of gears 212, 214 and 216 in succession.

Figure 6:
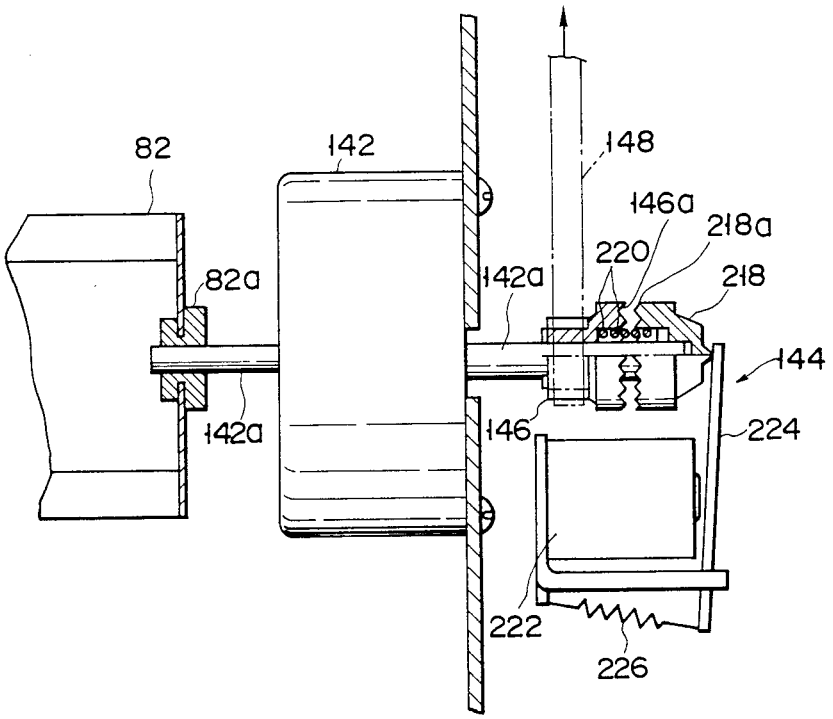
FIG. 6. is a cutaway view of a dog clutch of the drive unit shown in FIG. 4.

FIG. 6 shows dog clutch 144. Gear 146 is mounted on shaft 142*a* of motor 142. It is allowed to rotate freely around shaft 142*a*, but is prevented from moving in the axial direction of the shaft. Movable block 218 is fitted on shaft 142*a*. It is fixed so as not to be able to rotate freely around shaft 142*a*, but is movable in the axial direction. Spring 220 is disposed between block 218 and gear 146. The movable block is urged to move away from gear 146 by spring 220. The facing portions of gear 146 and movable block 218 are formed with mating teeth 146*a* and 218*a*, respectively.

Solenoid 222 is located beside motor 142. It is provided with armature 224. The distal end portion of armature 224 is adapted to engage movable block 218. Spring 226 is disposed between the respective proximal end portions of armature 224 and solenoid 222. Thus, armature 224 is continually urged to move away from solenoid 222 by spring 226.

Figure 7:
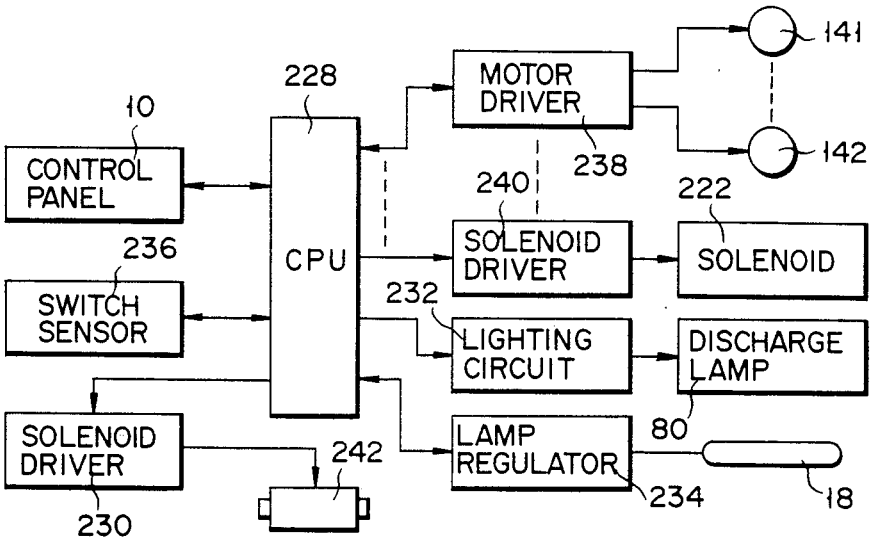
FIG. 7 is an electric circuit diagram of the drive unit shown in FIG. 4.

FIG. 7 shows the principal part of an electric circuit. CPU 228 serves to control the operation of the whole copying machine. It is connected with control panel 10, solenoid driver 230, lighting circuit 232, lamp regulator 234, switch sensor 236, motor driver 238, and solenoid driver 240. Solenoid driver 230 drives solenoid 242 which is used to operate cleaning blade 98. Lighting circuit 232 and lamp regulator 234 serve to drive discharge lamp 80 and exposure lamp 18, respectively. Switch sensor 236 is composed of switches 58 and 60 and other elements. Motor driver 238 serves to drive motors 141 and 142 and the like. Solenoid driver 240 serves to drive solenoid 222 which is used to operate dog clutch 144.

Figure 8:
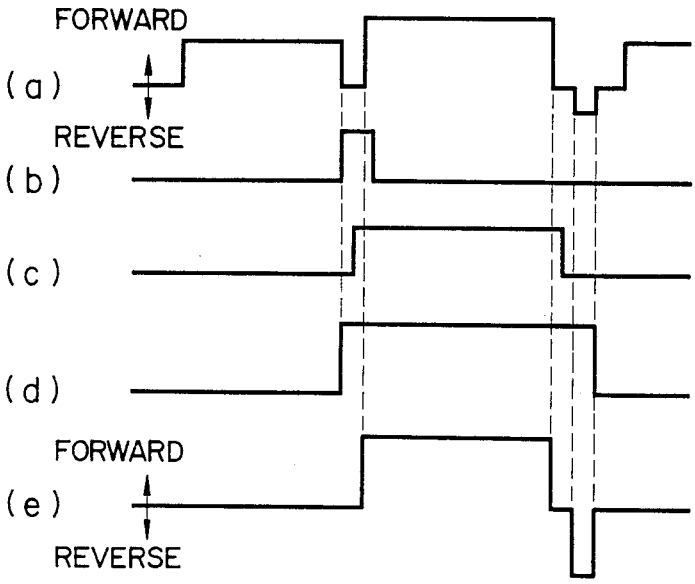
FIG. 8 is a diagram for illustrating the operation of the drive unit shown in FIG. 4.

Referring now to FIG. 8, the operation of the aforementioned arrangement will be described.

In a normal standby state, motor 142 is rotated at low speed, as shown in FIG. 8(*a*). In this state, solenoid is de-energized, as shown in FIG. 8(*d*), so that movable block 218 of dog clutch 144 is disengaged from gear 148. Accordingly, only cooling fan 82 is rotated at low speed by motor 142.

When copy key 92 is operated, as shown in FIG. 8(*b*), solenoids 222 and 242 are excited successively, as shown in FIGS. 8(*c*) and 8(*d*). Thereupon, cleaning blade 98 is caused to engage the surface of photoconductive drum 26, and movable block 218 of dog clutch 144 and gear 146 engage each other. In this state, motor 142 is rotated in the counterclockwise direction of FIG. 4. As a result, drum 26, selected developing unit 40 or 42, aligning rollers 56, conveyor belt 70, fixing rollers 72, and exit rollers 74 are rotated, as shown in FIG. 8(*e*). At the same time, motor 141, discharge lamp 80, exposure lamp 18, various chargers 36, 66 and 68, etc., are operated properly. The copying operation is performed in this manner.

When the aforementioned copying operation ends, motor 142 is stopped, as shown in FIG. 8(*a*). Thereafter, solenoid 242 is de-energized, as shown in FIG. 8(*c*). Thereupon, cleaning blade 78 is disengaged from the surface of photoconductive drum 26. Thereafter, motor 142 is rotated reversely or in the clockwise direction of FIG. 4, as shown in FIG. 8(*a*). At this time, timing belt 148 is prevented from operating by the agency of one-way clutch 154. Therefore, aligning rollers 56 and other elements cannot operate, and only drum 26 is rotated in the clockwise direction of FIG. 4. When drum 26 is rotated reversely through a predetermined angle, solenoid 222 is de-energized, as shown in FIG. 8(*d*). As a result, dog clutch 144 is released and motor 142 is stopped, so that the reverse rotation of drum 26 is stopped, as shown in FIG. 8(*e*). Thereafter, motor 142 is rotated at low speed as aforesaid, for standby operation.

According to the embodiment described above, photoconductive drum 26 is driven by means of motor 142, and the driving force of motor 142 is transmitted to developing units 40 and 42, fixing rolers 72, etc., by means of one-way clutch 154. In the copying operation, all these elements are driven by motor 142. When the copying operation ends, motor 142 is reversed, thereby shifting the stop position of drum 26. When the drum 26 is rotated reversely, therefore, it alone is allowed to operate by the agency of clutch 154. Accordingly, the force of inertia acting on motor 142 is smaller than in the conventional case. Thus, motor 142 can be driven more easily.

After motor 142 is rotated reversely through a predetermined angle, moreover, solenoid 222 is de-energized, so that dog clutch 144 is released. Thereupon, the driving force of motor 142 cannot be transmitted to photoconductive drum 26, so that drum can be stopped securely at a predetermined position. Accordingly, the toner particles remaining on the drum surface can be removed without fail. Thus, the copy images can be prevented from being lowered in quality by the residual toner particles.

During the standby period before the start of the copying operation, furthermore, dog clutch 144 is released. Thereupon, only cooling fan 82 is rotated at low speed by motor 142, thereby cooling the inside of housing 2. It is unnecessary, therefore, separately to provide a motor and a fan for exclusive use. Thus, the number of components used can be reduced, and the manufacturing costs can be lowered.

It is to be understood that the present invention is not limited to the embodiment described above, and that various changes and modifications may be effected therein by one skilled in the art without departing from the scope or spirit of the invention.

In the copying operation, as described in detail herein, photoconductive drum 26 and other components are driven simultaneously by means of motor 142. If motor 142 is reversed after the end of the copying operation, only drum 26 is allowed to rotate reversely by the action of one-way clutch 154. Thereupon, the force of inertia acting on motor 142 becomes smaller, so that drum 26 can be easily stopped at the predetermined position with high accuracy by being rotated reversely. After drum 26 is stopped in this manner, the transmission of the driving force by means of dog clutch 144 is discontinued, and only fan 82 is driven by motor 142. Thus, the copying operation and the cooling operation, during the standby period before the start of the copying operation, can be performed with use of one and the same motor.

What is claimed is:

1. A drive unit for a copying apparatus, comprising:

an image carrier rotatable in both forward and reverse directions and carrying a latent image thereon;

visualizing means rotatable in both forward and reverse directions and adapted to visualize the latent image;

cooling means for cooling the inside of the copying machine;

drive means rotatable in both forward and reverse directions and adapted to drive the image carrier, the visualizing means, and the cooling means;

first driving force transmission means for transmitting the driving force of the drive means to the image carrier, to rotate the image carrier in the forward and reverse directions as the drive means rotates in the forward and reverse directions, respectively;

second driving force transmission means adapted to transmit the driving force of the drive means to the visualizing means, to rotate the visualizing means in the forward direction when the drive means rotates in the forward direction, and not to transmit the driving force of the drive means to the visualizing means when the drive means rotates in the reverse direction;

intermittent driving force transmission means for intermittently allowing the first driving force transmission means to transmit the driving force to the image carrier and second driving force transmission means to transmit the driving force to the visualizing means; and third driving force transmission means for transmitting the driving force of the drive means directly to the cooling means.

2. The drive unit for a copying apparatus according to claim 1, wherein said intermittent driving force transmission means includes a claw clutch.

3. The drive unit for a copying apparatus according to claim 1, wherein said second driving force transmission means includes a one-way clutch.

4. The drive unit for a copying apparatus according to claim 1, wherein said visualizing means includes developing means for developing the latent image, to form a developer image, and fixing means for fixing the developer image to an image support medium.

5. The drive unit for a copying apparatus according to claim 4, wherein said developing means includes a developing roller for developing the latent image, to form a developer image.

6. The drive unit for a copying apparatus according to claim 4, wherein said fixing means includes a fixing roller for fixing the developer image to the image support medium.

7. The drive unit for a copying apparatus according to claim 1, wherein said third driving force transmission means includes fastening means for connecting the cooling means direcly to the drive means.

8. The drive unit for a copying apparatus according to claim 1, wherein said drive means includes a motor rotatable in both forward and reverse directions.

9. The drive unit for a copying apparatus according to claim 1, wherein said cooling means includes a fan for cooling the inside of the copying machine.

10. A drive unit for a copying apparatus, comprising:

an image carrier rotatable in both forward and reverse directions and carrying a latent image thereon;

visualizing means rotatable in both forward and reverse directions and adapted to visualize the latent image;

cooling means for cooling the inside of the copying machine;

drive means rotatable in both forward and reverse directions and adapted to drive the image carrier, the visuaizing means, and the cooling means;

first driving force transmission means for transmitting the driving force of the drive means to the image carrier, to rotate the image carrier in the forward and reverse directions as the drive means rotates in the forward and reverse directions, respectively;

second driving force transmission means adapted to transmit the driving force of the drive means to the visualizing means, to rotate the visualizing means in the forward direction when the drive means rotates in the forward direction, and not to transmit the driving force of the drive means to the visualizing means when the drive means rotates in the reverse direction;

intermittent driving force transmission means for intermittently allowing the the first driving force transmission means to transmit the driving force to the image carrier and second driving force transmission means to transmit the driving force to the visualizing means;

third driving force transmission means for transmitting the driving force of the drive means directly to the cooling means; and signal supply means adapted to supply the drive means with a signal for forward rotation thereof at the time of a copying operation, to supply the drive means with a signal for reverse rotation thereof after completion of the copying operation, and to supply the intermittent driving force transmission means with a signal for interrupting the transmission of the driving force after the drive means is rotated reversely through a predetermined angle.

11. A drive unit for a copying apparatus, comprising:

an image carrier rotatable in both forward and reverse directions and carrying a latent image thereon;

visualizing means rotatable in both forward and reverse directions, and adapted to visualize the latent image by means of a developing agent, thereby forming a developer image on the surface of the image carrier, and to transfer and fix the developer image from the image carrier to the surface of an image support medium;

cleaning means adapted to be brought into contact with the image carrier at the time of a copying operation, thereby removing particles of the developing agent remaining on the surface of the image carrier after image transfer, and to be disengaged from the image carrier after completion of the copying operation;

cooling means for cooling the inside of the copying machine;

drive means rotatable in both forward and reverse directions and adapted to drive the image carrier, the visualizing means, and the cooling means;

first driving force transmission means for transmitting the driving force of the drive means to the image carrier, to rotate the image carrier in the forward and reverse directions as the drive means rotates in the forward and reverse directions, respectively;

second driving force transmission means adapted to transmit the driving force of the drive means to the visualizing means, to rotate the visualizing means in the forward direction when the drive means rotates in the forward direction, and not to transmit the driving force of the drive means to the visualizing means when the drive means rotates in the reverse direction;

intermittent driving force transmitting means for intermittently allowing the first driving force transmission means to transmit the driving force to the image carrier and second driving force transmission means to transmit the driving force to the visualizing means;

third driving force transmission means for transmitting the driving force of the drive means directly to the cooling means; and signal supply means adapted to supply the drive means with a signal for forward rotation thereof at the time of a copying operation, to supply the drive means with a signal for reverse rotation thereof after completion of the copying operation, and to supply the intermittent driving force transmission means with a signal for interrupting the transmission of the driving force after the drive means is rotated reversely through a predetermined angle.

* * * * *